US007156466B1

(12) United States Patent
Chang

(10) Patent No.: US 7,156,466 B1
(45) Date of Patent: Jan. 2, 2007

(54) CHAIR ARM ADJUSTMENT MECHANISM

(75) Inventor: Feng-mei Chang, Shia Yin Hsian (TW)

(73) Assignee: Chuan Lin Wang Co., Ltd., Shia Yin Hsian (TW)

( * ) Notice: Subject to any disclaimer, the term of this patent is extended or adjusted under 35 U.S.C. 154(b) by 0 days.

(21) Appl. No.: 11/307,185

(22) Filed: Jan. 26, 2006

(51) Int. Cl.
*A47C 7/54* (2006.01)

(52) U.S. Cl. ..... 297/411.36; 297/411.35; 297/411.2; 297/411.1; 297/115

(58) Field of Classification Search ..... 297/411.36, 297/411.35, 411.2, 411.1, 286, 394, 115, 297/113; 248/118, 118.3
See application file for complete search history.

(56) References Cited

U.S. PATENT DOCUMENTS 5,388,892 A * 2/1995 Tornero ..... 297/411.36
5,620,233 A * 4/1997 Corwin ..... 297/411.36
6,209,840 B1 * 4/2001 Chen ..... 248/407
6,336,680 B1 * 1/2002 Lee ..... 297/411.36
6,398,309 B1 * 6/2002 Chen ..... 297/411.36
6,502,904 B1 * 1/2003 Hansen ..... 297/411.35
6,517,158 B1 * 2/2003 Wang ..... 297/411.36
6,974,190 B1 * 12/2005 Hung ..... 297/411.36
6,976,739 B1 * 12/2005 Wang ..... 297/411.35

* cited by examiner

*Primary Examiner*—Peter M. Cuomo
*Assistant Examiner*—Erika Garrett
(74) *Attorney, Agent, or Firm*—Alan D. Kamrath; Nikolai & Mersereau, P.A.

(57) ABSTRACT

A chair arm adjustment mechanism is disclosed. The mechanism includes a T-shaped driving member, a spring biased trigger member in a vertical section of the driving member and having a finger tab, a lock members including two bifurcated ends; a positioning member fitted around a portion of the driving member and including a longitudinal channel, and an upper and lower shrouds. Lifting the finger tab will pivot the bifurcated ends of the lock members toward each other until a joining portion thereof is stopped. Releasing the finger tab will lower the trigger member, pivot the bifurcated ends away each other until the joining portion thereof is stopped.

2 Claims, 7 Drawing Sheets

CHAIR ARM ADJUSTMENT MECHANISM

BACKGROUND OF THE INVENTION

1. Field of Invention

The present invention relates to furniture members such as chair arms adapted to be manually adjusted and operated by, for example, a finger tab.

2. Related Art

Mechanisms for relatively positioning telescopic members of a piece of furniture are well known. Such mechanism is designed to enable a person to adjust a position of one member of the piece of furniture (e.g., chair arm) relative to another member thereof and position same in order to fit different individuals with various heights or job tasks. However, such prior mechanisms are typically relatively complex in constructions, costly to manufacture, and unreliable in use. Further, they are troublesome to manipulate or operate, and are visually unattractive and detract from the appearance of the piece of furniture. Thus, it is desirable to provide an improved mechanism for relatively positioning telescopic members of a piece of furniture (e.g., chair arm) in order to overcome the inadequacies of the prior art and contribute significantly to the advancement of the art.

SUMMARY OF THE INVENTION

It is therefore an object of the present invention to provide a chair arm adjustment mechanism comprising a T-shaped driving member including a horizontal top plate having through holes and a vertical portion of recessed section, the vertical portion including two lower opposite openings, two inward protrusions formed on two opposite walls of the vertical section and each disposed above the opening, and a bridge interconnected the walls of the vertical section; an inverted L-shaped trigger member disposed in a longitudinal groove of the vertical portion and including a horizontal top portion, an aperture on the top portion, an intermediate, longitudinal slot, a bottom extension slidably passed a gap between the protrusions of the driving member, an opening formed on an open end of the extension, and a finger tab provided around the top portion; a pair of lock members including one end each having a through hole and the other end having two bifurcations, a pin being inserted through the through hole to form a toggle joint and the opening of the extension of the trigger member; a resilient member biased between the finger tab and the aperture; a first fastener fixedly screwed through the slot into a rear wall of the longitudinal groove of the vertical portion for limiting a vertical displacement of the trigger member between an upper end of the slot and a lower end thereof; a second fastener screwed through the horizontal top plate and the resilient member into the aperture for anchoring the resilient member; a first and second positioning members fitted around the vertical portion and each of the first and second positioning member including a longitudinal, central position limitation channel to cooperate with the bifurcated ends of the lock members so as to limit the lifting or lowering movement of the lock members; an upper shroud receiving the positioning members assembled with the driving member and trigger member and having a top secured to an arm pad and a side opening with the finger tab protruded therefrom; and a lower shroud including an intermediate shoulder adapted to support the upper shroud rested thereon. Whereby lifting the finger tab will compress the resilient member until the first fastener reaches the lower end of the slot, pivot the bifurcated ends of the lock members toward each other until a joining portion thereof is stopped by the gap; and releasing the finger tab will expand the energized resilient member to lower the trigger member until the first fastener reaches the upper end of the slot, pivot the bifurcated ends of the lock members away each other until joined ends of the lock members is stopped by the bridge.

The above and other objects, features and advantages of the present invention will become apparent from the following detailed description taken with the accompanying drawings.

DETAILED DESCRIPTION OF THE INVENTION

Figure 1:
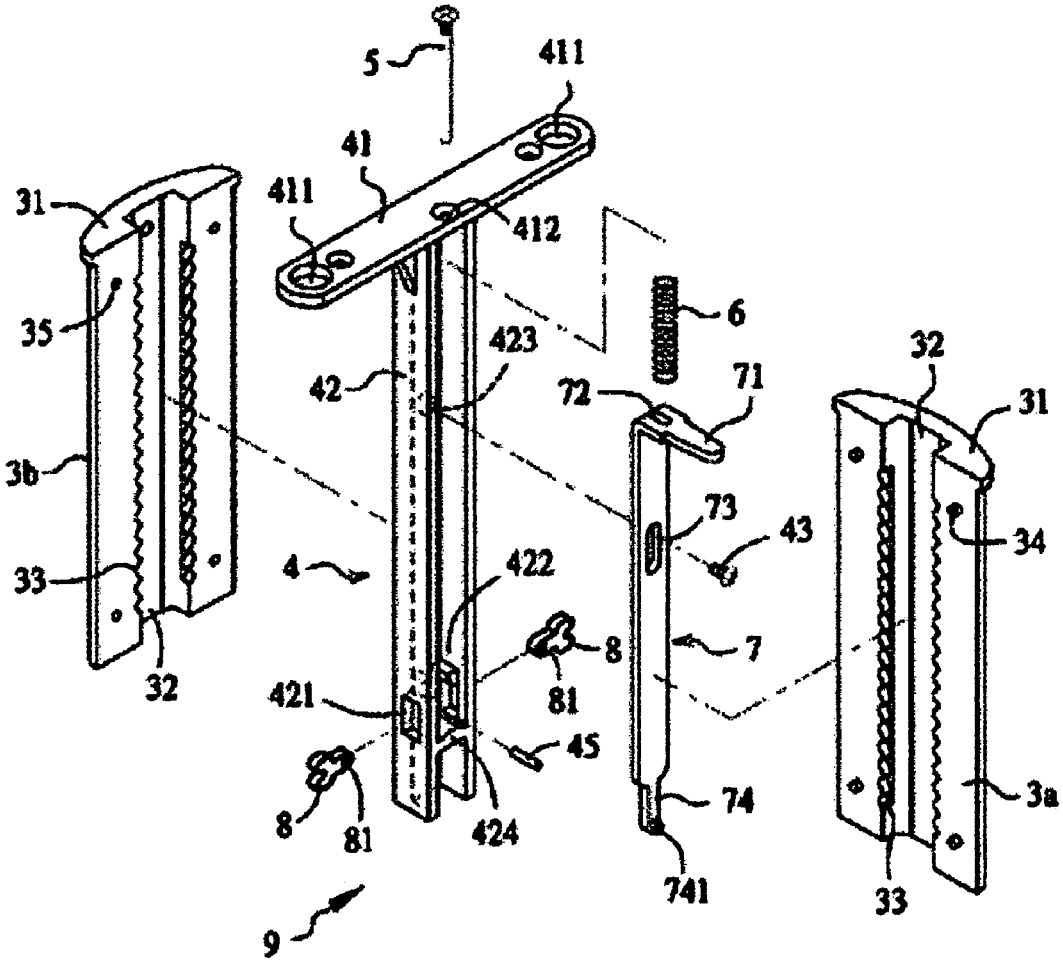
FIG. 1 is an exploded view of a preferred embodiment of the adjustment mechanism according to the invention.
Figure 2A:
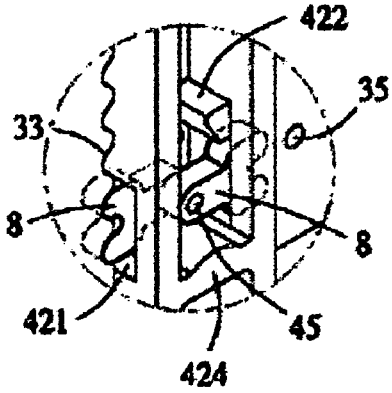
FIG. 2 is an exploded perspective view of the not completely assembled mechanism in FIG. 1 to be assembled with an upper shroud and a lower shroud of a chair arm.
Figure 2:
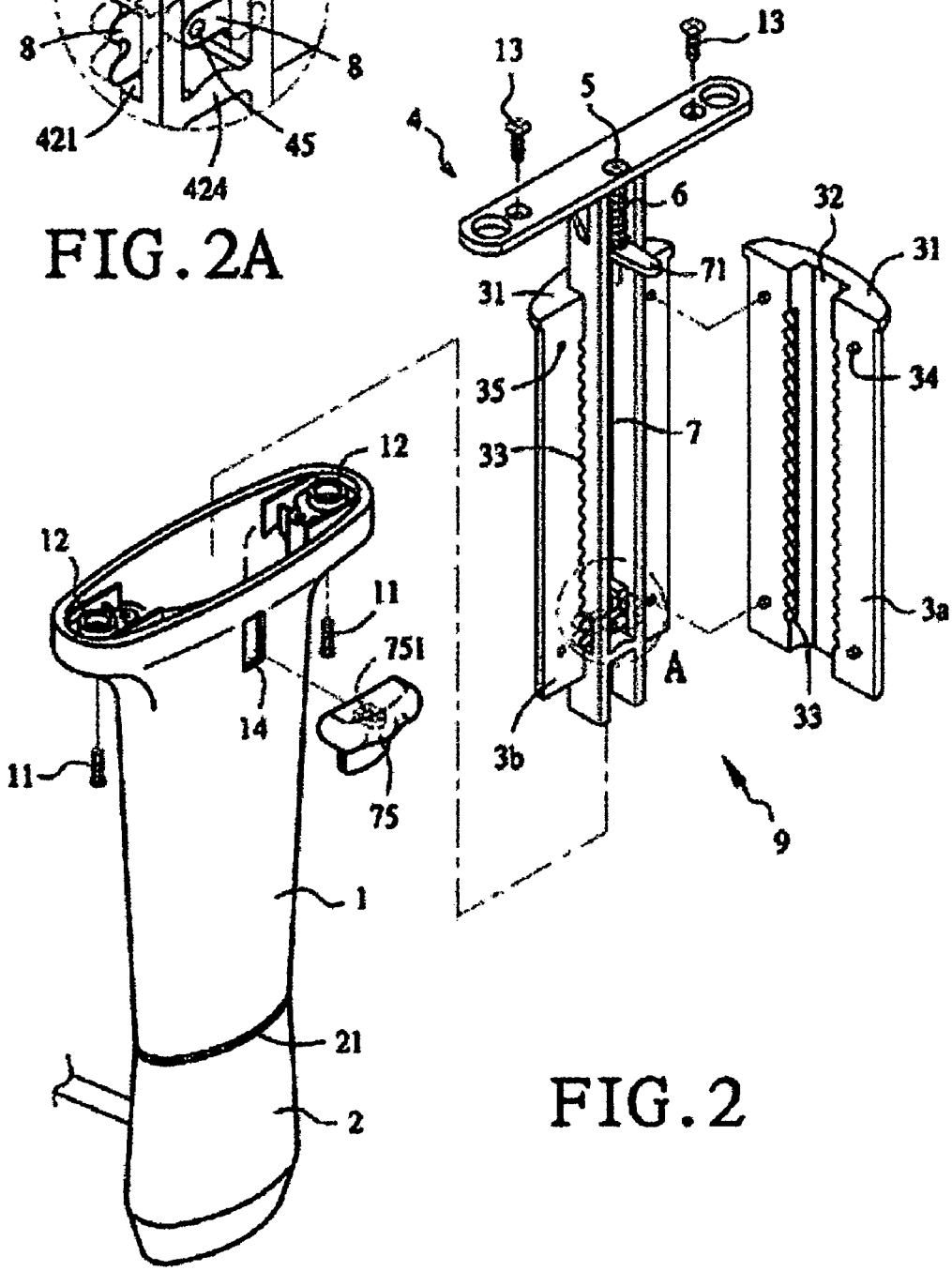
Figure 3:
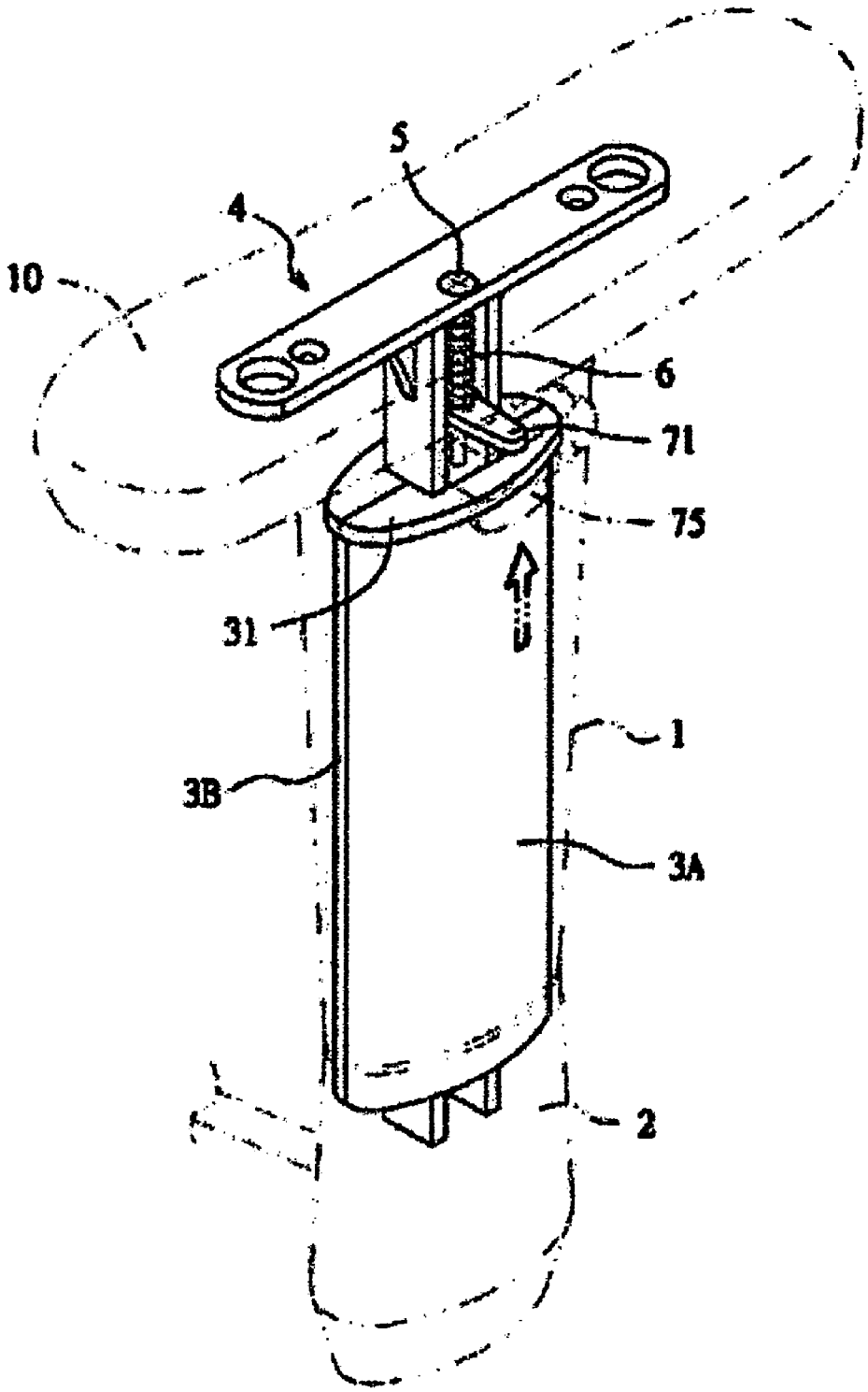
FIG. 3 is a perspective phantom view of the assembled mechanism and the chair arm in FIG. 2.

Referring to FIGS. 1, 2, and 3, an adjustment mechanism 9 for a chair arm in accordance with a preferred embodiment of the invention is shown. The adjustment mechanism 9 comprises an upper shroud 1, a lower support 2, an elongate first positioning member 3*a*, an elongate second positioning member 3*b*, a T-shaped driver 4, a pin 5 with a top thread, a helical spring 6, an L-shaped trigger member 7, two lock members 8 and an arm pad 10.

The upper shroud 1 has upper holes 12 on the top and a rectangular side opening 14. The lower support 2 is fixedly connected to an underside of a chair seat (not shown) and includes an intermediate shoulder 21 with the shroud 1 being rested thereon to limit the minimum height of the chair arm.

Each of the positioning members 3*a* and 3*b* has a top edge 31, a longitudinal, central channel 32, a plurality of notches 33 on both sides of the channel 32. The first positioning member 3*a* further has a plurality of protrusions 34 proximate four corners of a rectangular inner surface and the second positioning member 3*b* further has a plurality of holes 35 positioning related to the plurality of protrusions 34 for assembly.

The T-shaped driving assembly 4 includes a horizontal top plate 41 having two through holes 411 for receiving protruding holes 12 of the upper shroud 1. The top plate 41 further has a central hole 412 and a vertical portion 42 of U section. The vertical portion 42 includes a longitudinal groove defined by two opposite and a rear vertically elongated walls, an intermediate protuberance 423 formed on the rear wall, two lower rectangular opposite openings 421, two inwardly projected protrusions 422 formed on two opposite walls of the vertical portion 42 and projected from a top edge of the opening 421, and a bridge 424 interconnected the walls of the vertical portion 42. The bridge 424 is across two bottom edges of the openings 421 and having an arcuate top portion.

The trigger member 7 has a width determined by the longitudinal groove of the vertical portion 42 and includes a horizontal top portion 71, a top aperture 72 through the top portion 71, an intermediate, longitudinal slot 73, a bottom extension 74, an opening 741 formed on an open end of the extension 74, and a finger tab 75 including an inner cavity 751.

The lock members 8 is disposed in the openings 421 and each having a hole 81 at one end and two bifurcated at the other ends.

Figure 4:
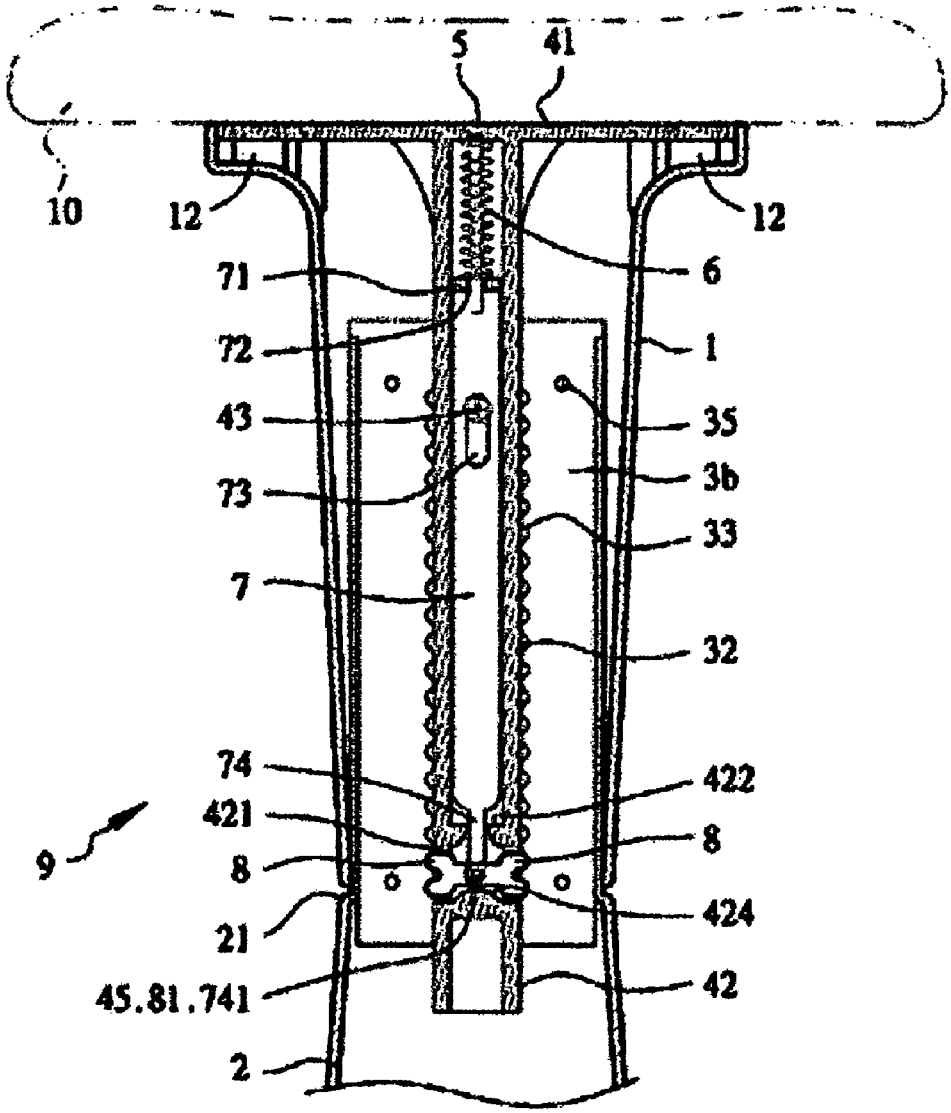
FIG. 4 is a longitudinal sectional view of FIG. 3 where the chair arm is positioned at its minimum height.

An assembly operation of the invention will be described in detailed below. Referring to FIGS. 1 and 4, the trigger member 7 is placed in the elongated groove of the vertical portion 42. The protuberance 423 passes through the slot 73 and a screw 43 is then screwed into the protuberance 423 for securing. A pin 45 is inserted through the holes 81 into the opening 741 to cause the lock members 8 to form a toggle joint. The helical spring 6 is placed between the hole 412 and the aperture 72. The pin 5 is screwed through the hole 412 and the spring 6 into the aperture 72 for anchoring the spring 6. The first and second positioning members 3*a* and 3*b* are then combined together with the assembled driving member 4 and the trigger member 7 sandwiched therebetween, the protrusions 34 being inserted into the holes 35, and the bifurcated ends of each lock member 8 are lockingly engaged with a pair of adjacent notches 33 at either side of the positioning members 3*a* and 3*b*. The assembled positioning members 3*a* and 3*b* with the driving member 4 and trigger member 7 are then disposed inside of the upper shroud 1 assembled with the lower shroud 2, with the top edge 31 being sit on the top of the upper shroud 1, the top portion 71 protrudes out of the opening 14, and the protruding holes 12 passing through the through holes 411. The driving member 4 is then secured onto the upper shroud 1 by screws 13. The cavity 751 is then put onto the top portion 71 for mounting the finger tab 75. Finally, the shroud 1 and the arm pad 10 are fastened together by screwing screws 11 through the holes 12 into the arm pad 10.

As shown in FIG. 4, the chair arm is positioned at its minimum height, the lock members 8 are disposed horizontally and have its bifurcated ends passing through the openings 421 and locked in the notches 33. The screw 43 is disposed in an upper end of the slot 73. The spring 6 is relatively expanded. The shroud 1 is rested on the shoulder 21.

Figure 5:
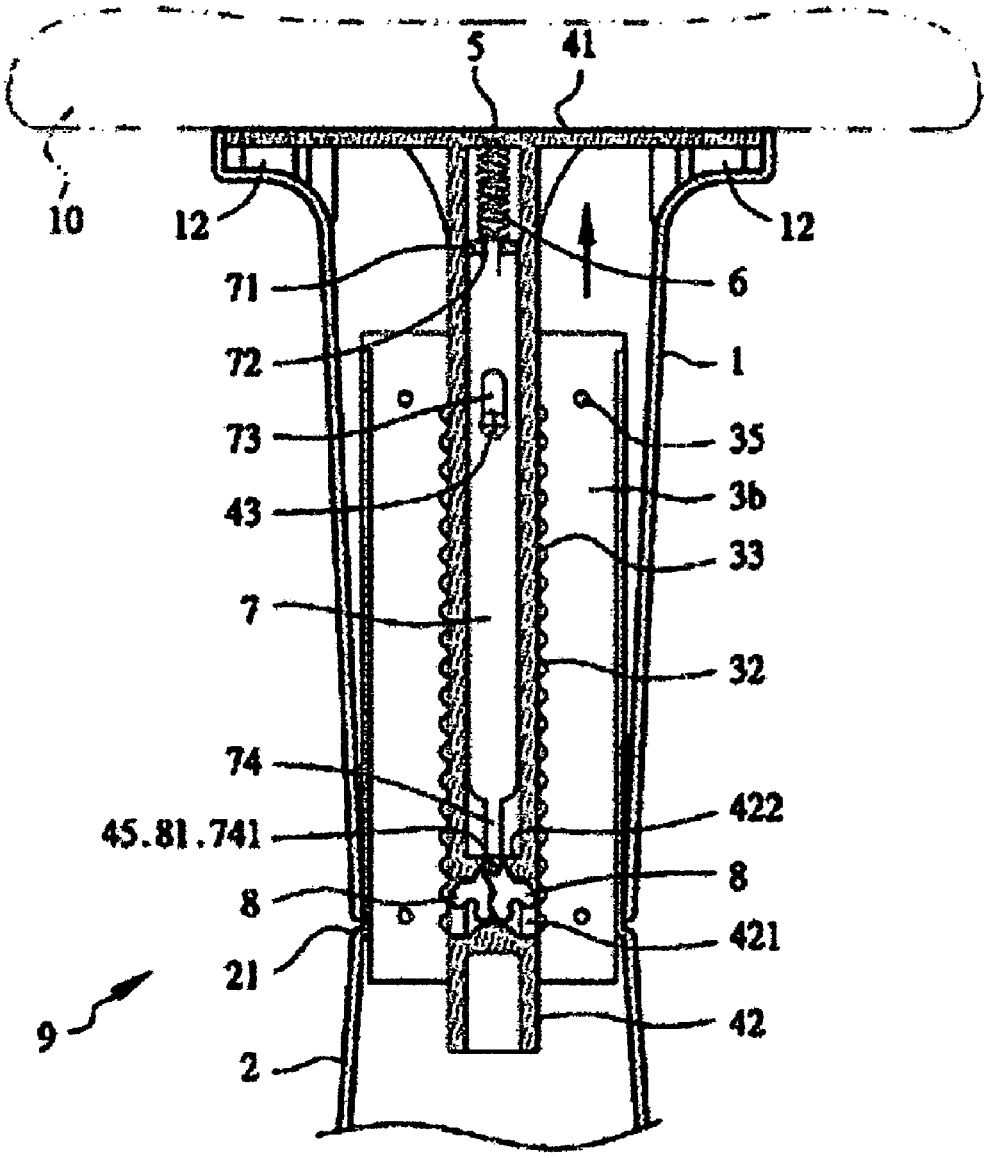
FIG. 5 is a view similar to FIG. 4 where the finger tab is lifted prior to extending the chair arm.
Figure 6:
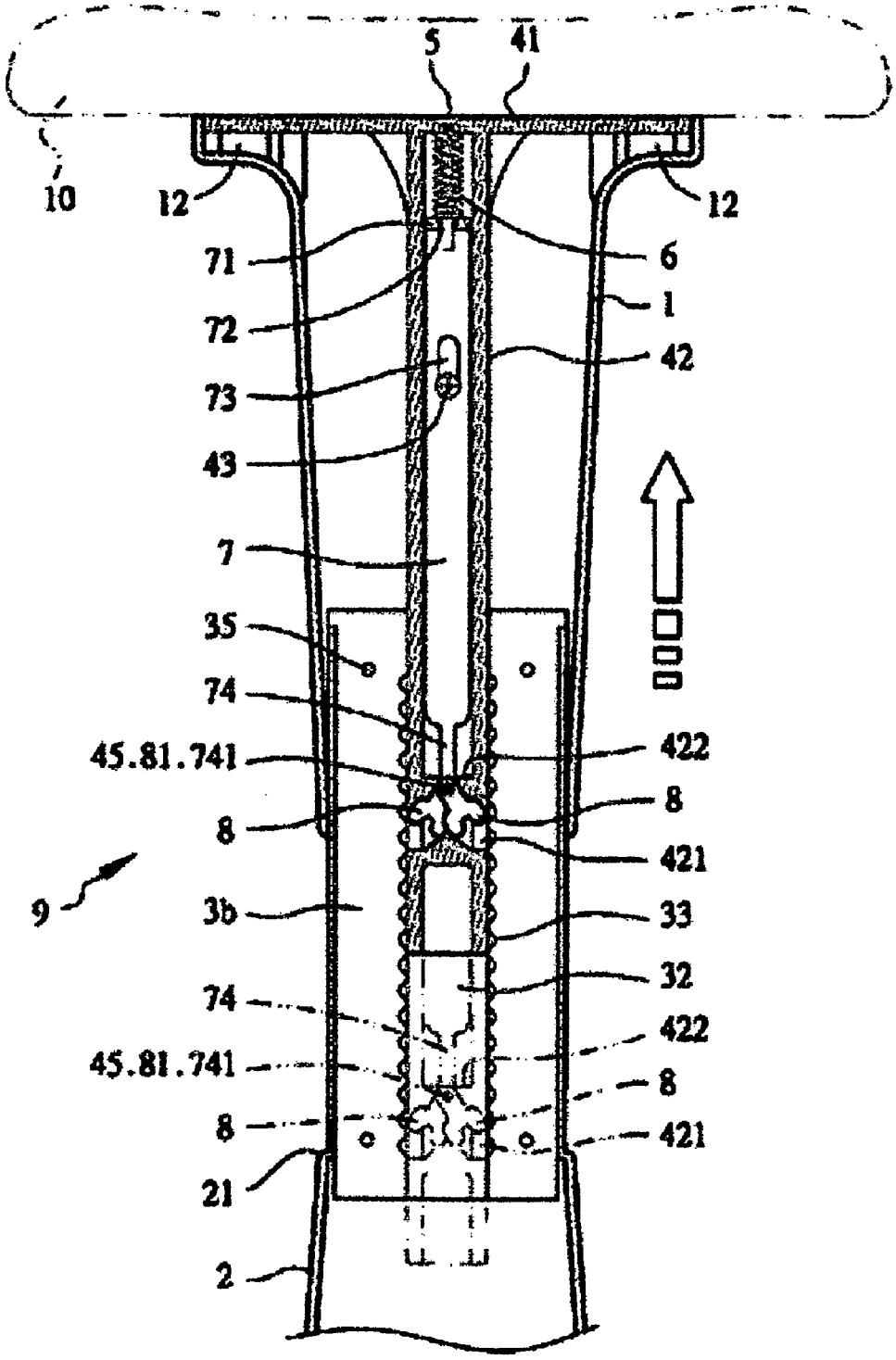
FIG. 6 is a view similar to FIG. 4 where the chair arm is extending.
Figure 7:
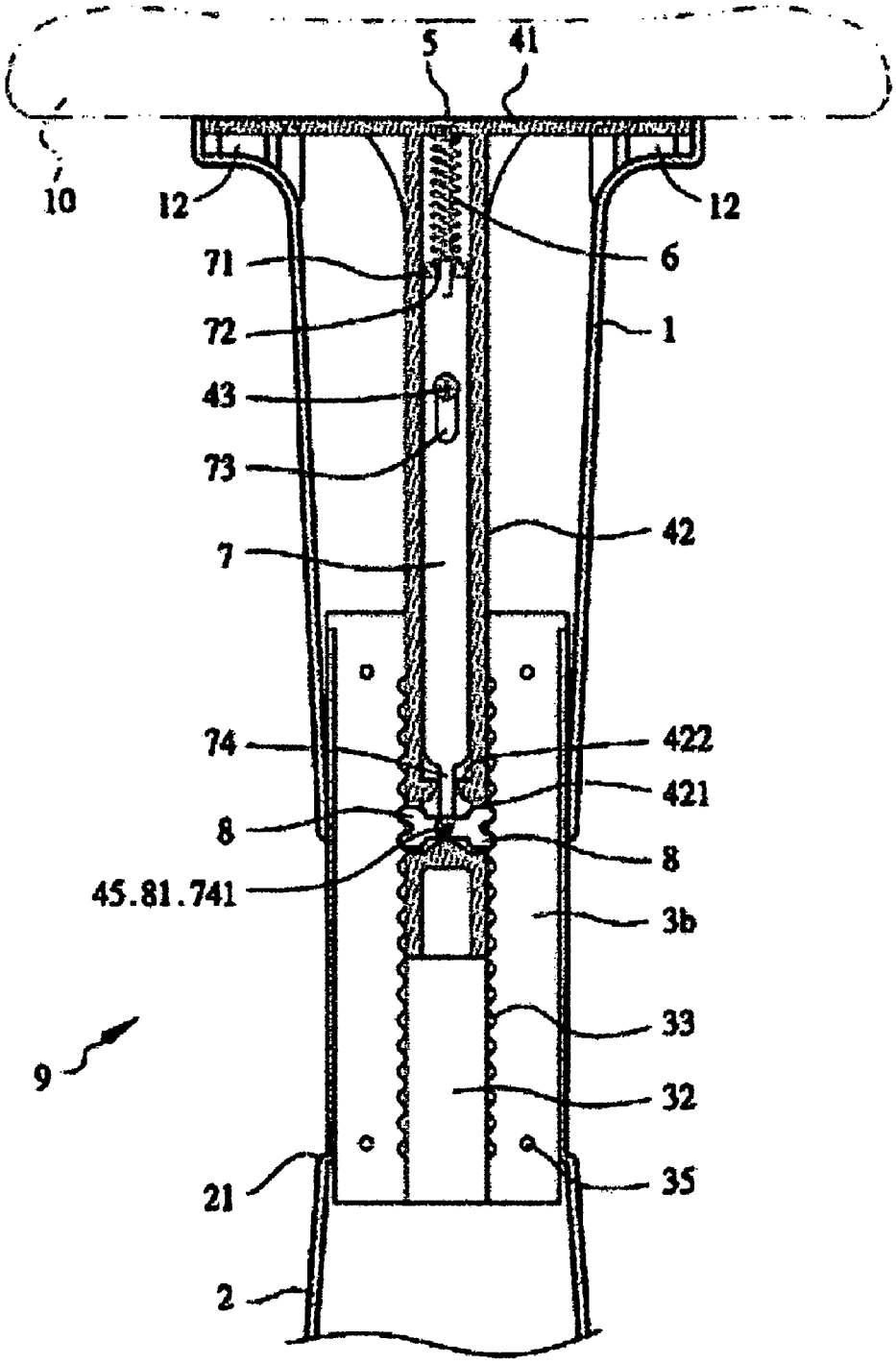
FIG. 7 is a view similar to FIG. 4 where the chair arm is positioned at a desired height after being extended.

Referring to FIGS. 5, 6, and 7 in conjunction with FIG. 4, a height adjusting and positioning operation of the invention will be described in detailed below. A user may hold the finger tab 75 and lift it to compress the spring 6 until the screw 43 reaches a lower end of the slot 73. At the same time, the bifurcated ends of the lock members 8 pivot toward each other until the ends having the through holes 81 are stopped by the gap between the protrusions 422 due to the lifting of the extension 74. At this position, the lock members 8 clear the notches 33 and thus are unlocked (see FIG. 5). Next, the user may continue the lifting as indicated by arrow in FIG. 6 until a desired height of the chair arm is reached. At this time, the user may stop the lifting and release the finger tab 75. Immediately thereafter, the energized spring 6 expands to push and lower the trigger member 7 and the screw 43 reaches the upper end of the slot 73. At the same time, the bifurcated ends of the lock members 8 pivot away each other until the ends having the through holes 81 are stopped by the arcuate top portion of the bridge 424 due to the lowering of the extension 74. At this position, the bifurcated ends of the lock members 8 enter the notches 33 for engagement and thus are locked (see FIG. 7). At this position, the lock members 8 are disposed substantially horizontally. Also, the chair arm is positioned at this height.

While the invention herein disclosed has been described by means of specific embodiments, numerous modifications and variations could be made thereto by those skilled in the art without departing from the scope and spirit of the invention set forth in the claims.

What is claimed is:

1. A chair arm adjustment mechanism comprising:

a T-shaped driving member including a horizontal top plate having through holes and a vertical portion of recessed section, the vertical portion including two lower opposite openings, two inward protrusions formed on two opposite walls of the vertical section and each disposed above the opening, and a bridge interconnected the walls of the vertical section;

an inverted L-shaped trigger member disposed in a longitudinal groove of the vertical portion and including a horizontal top portion, an aperture on the top portion, an intermediate, longitudinal slot, a bottom extension slidably passed a gap between the protrusions of the driving member, an opening formed on an open end of the extension, and a finger tab provided around the top portion;

a pair of lock members each including one end having a through hole and the other end having two bifurcations, a pin being inserted through the through holes to form a toggle joint and the opening of the extension of the trigger member;

a resilient member biased between the finger tab and the aperture;

a first fastener fixedly screwed through the slot into a rear wall of the longitudinal groove of the vertical portion for limiting a vertical displacement of the trigger member between an upper end of the slot and a lower end thereof;

a second fastener screwed through the horizontal top plate and the resilient member into the aperture for anchoring the resilient member;

a first and second positioning members fitted around the vertical portion and each of the first and second positioning member including a longitudinal, central position limitation channel to cooperate with the bifurcated ends of the lock members so as to limit the lifting or lowering movement of the lock members;

an upper shroud receiving the positioning members assembled with the driving member and trigger member and having a top secured to an arm pad and a side opening with the finger tab protruded therefrom; and a lower shroud including an intermediate shoulder adapted to support the upper shroud rested thereon;

whereby lifting the finger tab will compress the resilient member until the first fastener reaches the lower end of the slot, pivot the bifurcated ends of the lock members toward each other until the joined ends of the pair of lock members is stopped by the gap; and releasing the finger tab will expand the energized resilient member to lower the trigger member until the first fastener reaches the upper end of the slot, pivot the bifurcated ends of the lock members away each other until the joined ends of the lock members is stopped by the bridge.

2. The chair arm adjustment mechanism of claim 1, wherein each of the position limitation channels of the first and second positioning members having a plurality of notches.

* * * * *